US006056432A

United States Patent [19]

Oehninger et al.

[11] Patent Number: 6,056,432

[45] **Date of Patent: *May 2, 2000**

[54] WATCH HOUSING FOR A WRIST WATCH

[75] Inventors: Niklaus Oehninger, Littau, Switzerland; Georg Bunz, Dobel, Germany

[73] Assignee: Bunz Montres S.A., Littau, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,342

[22] Filed: Sep. 27, 1996

[30] Foreign Application Priority Data

Mar. 22, 1996 [EP] European Pat. Off. ..... 96810183

[51] Int. Cl.[7] ..... G04C 37/00; G04B 37/00

[52] U.S. Cl. ..... 368/281; 368/299; 368/309

[58] Field of Search ..... 368/88, 276, 281–282, 368/294–296, 309, 310, 299, 300

[56] References Cited

U.S. PATENT DOCUMENTS

| | | | |
|---|---|---|---|
| 1,484,420 | 2/1924 | Suderov | 368/281 |
| 1,798,619 | 3/1931 | Mealy | 368/282 |
| 2,207,512 | 7/1940 | Guild | 368/282 |
| 4,167,850 | 9/1979 | Schneider | 368/282 |
| 4,194,355 | 3/1980 | Nishida | 368/282 |
| 5,065,375 | 11/1991 | Gogniat | 368/281 |

FOREIGN PATENT DOCUMENTS

| | | | |
|---|---|---|---|
| 264875 | 4/1988 | European Pat. Off. | 368/282 |
| 0 296 661 | 12/1988 | European Pat. Off. . | |
| 0 443 366 | 8/1991 | European Pat. Off. . | |
| 0 736 824 | 10/1996 | European Pat. Off. . | |
| 1.399.320 | 9/1965 | France . | |
| 16 75 448 | of 0000 | Germany . | |
| 115155 | 6/1926 | Switzerland . | |
| 198194 | 6/1938 | Switzerland | 368/282 |
| 313418 | 4/1956 | Switzerland | 368/282 |
| 327165 | 1/1958 | Switzerland | 368/282 |
| 422 653 | 10/1966 | Switzerland . | |
| 538 139 | 7/1973 | Switzerland . | |
| 656505 | 7/1986 | Switzerland | 368/281 |
| 666 378 A3 | 7/1988 | Switzerland . | |
| 671 493 A3 | 9/1989 | Switzerland . | |
| 671 493 | 3/1990 | Switzerland . | |

*Primary Examiner*—Vit Miska
*Attorney, Agent, or Firm*—Townsend and Townsend and Crew LLP

[57] ABSTRACT

A watch housing has a mechanism carrier, an upper part and a base part which are installed on the mechanism carrier by screws which directly connect the upper part and the base part. Furthermore, sealing members are provided in order to make the watch housing water-tight. The design freedom for the watch housing is improved in advantageous manner by designing the mechanism carrier as a support element and also the upper and base parts as shells.

24 Claims, 4 Drawing Sheets

WATCH HOUSING FOR A WRIST WATCH

BACKGROUND OF THE INVENTION

The invention relates to a watch housing for a wrist watch in accordance with the preamble of claim 1.

A watch housing of this kind is known from SU-A-482 710. This watch housing has a housing ring with outwardly disposed lugs for holding a strap and through-bores, a crown tube, an upper part with threaded bores, a watch glass, a rotary ring with dial, two sealing elements and a base part. The sealing elements are arranged in the housing ring in such a way that the watch glass on the one hand and the base part on the other hand are in engagement with the sealing elements in order to install the watch mechanism in a watertight manner. This watch housing has the disadvantages that the housing ring is visible from the outside, that the watch housing does not convey the impression of being flat, and that when made in noble metal the costs are very high.

A watch housing is known from EP-A-0 443 366 that-contains an upper shell, a lower shell and a housing ring. The upper and lower shells lie with their edges against one another so that the edges of the shells are visible. The upper shell consists of glass. The watch housing thus represents a special design and thus has an appearance dependent on it.

SUMMARY OF THE INVENTION

The invention, as it is characterized in the claims, solves the object of providing a watch housing for a wrist watch which is of modular design and which can be freely styled with respect to its appearance and manufactured at favorable cost while retaining the water-tightness.

Through the modular design the scope for styling outside of the mechanism carrier is increased. The material for the mechanism carrier are upper and lower parts can be freely selected whereby a multiplicity of embodiments results. In particular the possibility is created of making the mechanism carrier of a cost-favorable material in large numbers and of making the upper part and the base part with a low wall thickness which leads to a saving of material in an advantageous manner, for example when using noble metals. Furthermore, only the mechanism carrier needs chip-forming machining, whereas the base part and/or the upper part can be formed as pressed parts.

BRIEF DESCRIPTION OF THE DRAWINGS

The invention will be explained in the following with reference to the accompanying drawings in which are shown.

DESCRIPTION OF THE PREFERRED EMBODIMENTS

Figure 3:
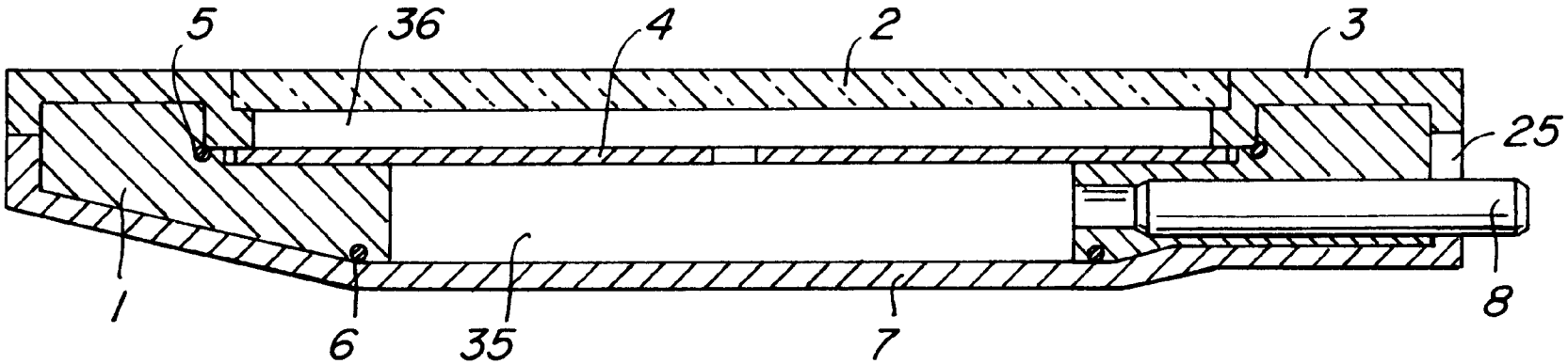
FIG. 3 shows a section along the line determined by the 9 and 3 o'clock position.

The watch housing under discussion here contains a mechanism carrier 1 which is formed as a carrier element and also a watch glass 2, an upper part 3, a dial 4, a first sealing ring 5, a second sealing ring 6 and a base part 7, which are arranged at the mechanism carrier 1. Furthermore, the watch housing has a crown tube 8 (FIG. 3). The mechanism carrier 1 is a ring-like body which has at one side a first recess 11 forming a shoulder 12 on which the upper part 3 lies, and having a second recess 13 which forms a shoulder 14 on which the dial 4 lies. A ring-like groove 15 is formed in the first recess 11. A second ring-like groove 16 is formed at the other side of the mechanism carrier 1. Furthermore, the workpiece carrier 1 has a plurality of apertures 17 which are formed on a pitch circle lying in the marginal portion of the mechanism carrier 1.

The upper part 3 is a shell-like body with a U-shaped edge portion, the outer flange of which forms a housing wall 19 and a contact surface 31, and the inner flange 20 of which is insertable into the first recess 11 of the mechanism carrier 1. Furthermore, the upper part 3 has a recess 21 which forms a shoulder 22 and is intended to receive the watch glass 2. Moreover, a plurality of cylindrical formations 23 are provided in the rim portion 18 which each have a blind bore with thread 24.

The base part 7 is a shell-like body, the margin 32 of which forms a ring-like contact surface 31', which is of identical shape to the contact surface 31 of the upper part. The base part 7 has two cut-outs 26 for a holder for a strap or a bracelet 27 (FIG. 2) and a cut-out 25 for the crown tube. A plurality of formations 28 are formed at the inner side of the base part 7 and have a through-hole 29 with a countersink 30 for a screw having a cylindrical head.

Figure 1:
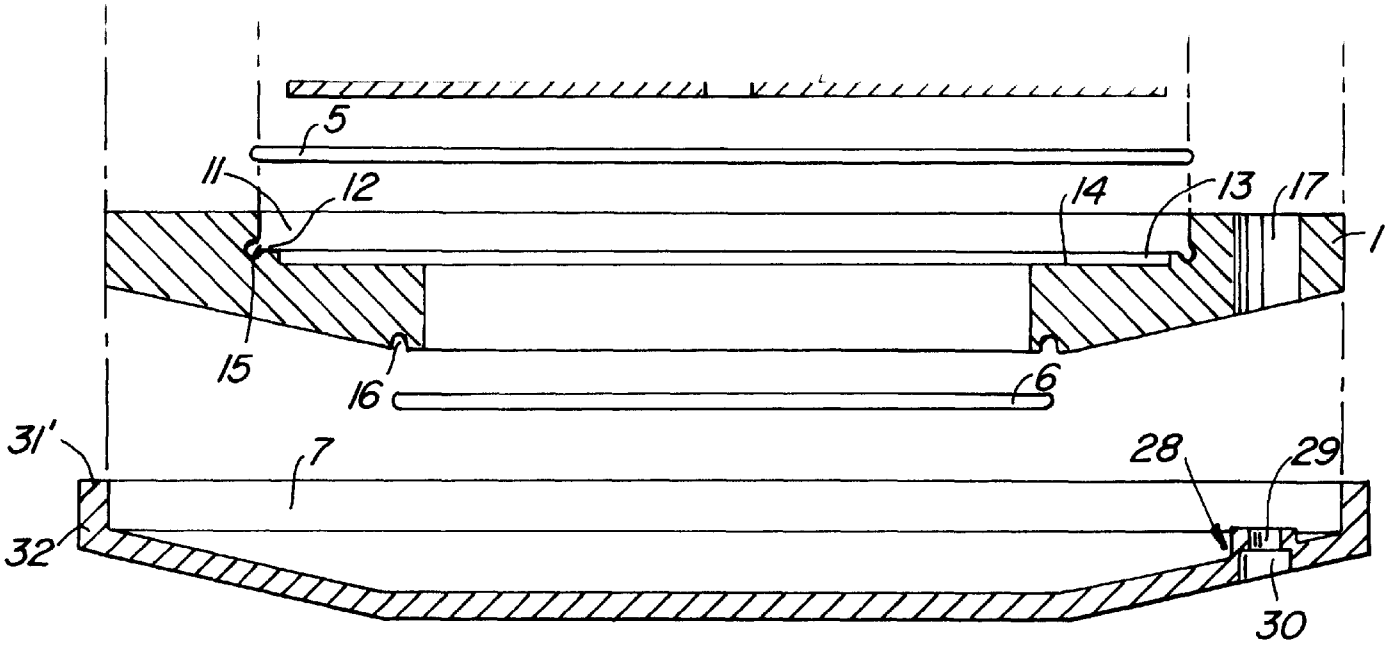
FIG. 1 shows a section along the line determined by the 8- and 2-hour position of an embodiment of a watch housing in accordance with the invention in an exploded illustration.
Figure 2:
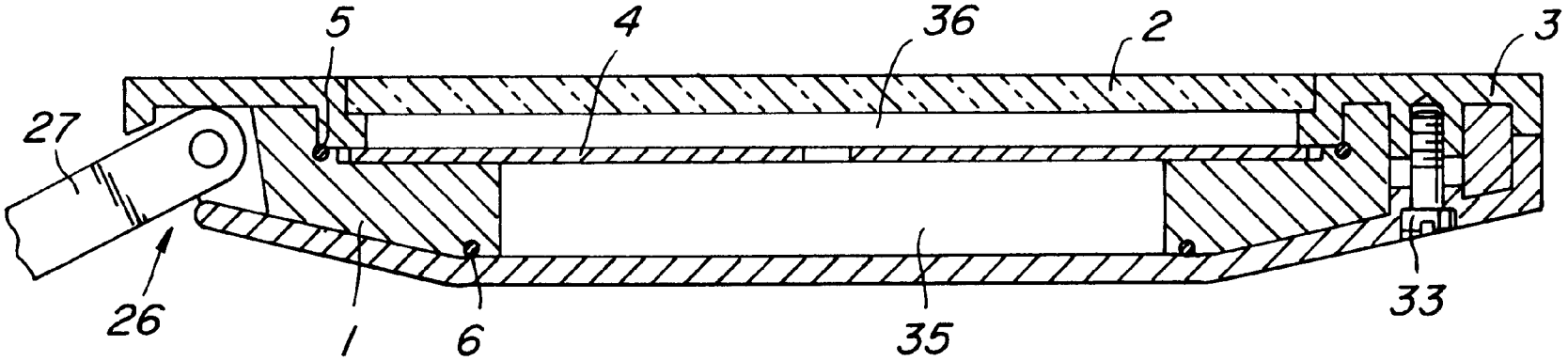
FIG. 2 shows a section along the line determined by the 12 and 2 o'clock position.

FIGS. 2 and 3 show the watch housing in the assembled state, with the initially discussed design of the mechanism carrier 1 as a support element being evident from these Figures. The holder is directly attached to the mechanism carrier 1 and the crown tube 8 is connected to the mechanism carrier 1 in water-tight manner. The sealing rings 5 and 6 are inserted into the ring-like grooves 15 and 16.

The other parts of the watch housing are installed on this component group or module. The dial 4 is arranged in the second recess 12. The upper part 3 with the watch glass 2 inserted therein in water-tight manner is inserted into the first recess 11 and holds the dial 4. The projections 23 of the upper part 3 project into the through-holes 17 in the mechanism carrier 1. The base part 7 is arranged on the other side of the mechanism carrier 1 and its projections 28 project into the through-holes 17 in the mechanism carrier 1.

The so-assembled watch housing is screwed together by means of screws 33 (FIG. 2) with the compartments 35 and 36 being sealed by the sealing rings 5 and 6. The upper part 3 and the base part 7 are arranged with their contact surfaces 31, 31' contacting one another and surround the mechanism carrier in a form-fitted manner.

Figure 4:
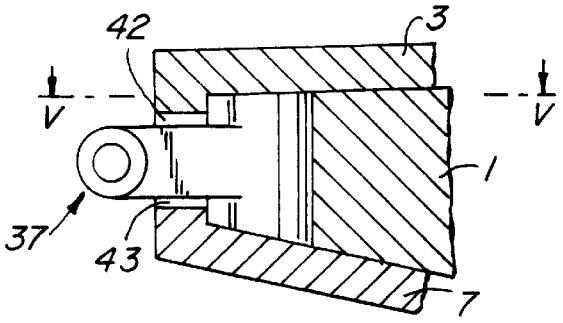
FIG. 4 shows a section through a portion in the 12 o'clock position with an embodiment of a holder for a watch strap.
Figure 5:
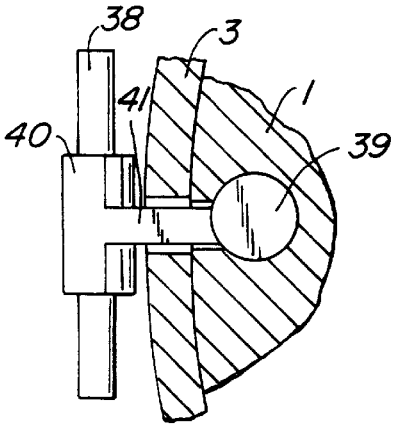
FIG. 5 shows a section along the line V—V in FIG. 4.

FIGS. 4 and 5 show a holder for a strap comprising a holding member 37 and a strap holder 38. The holding member has a cylindrical insert part 39 which is arranged in the mechanism carrier 1, a tubular receiving part 40 in which a pin is arranged as a strap holder 37, and a web 41 in order to arrange the strap holder outside of the watch housing. In each case a recess 42, 43 is formed in the upper part and the base part 3, 7 through which the web 41 projects. The advantages of this embodiment lie in the fact that the interruption in the contact surfaces 31, 31' is small in order to avoid the penetration of any form of particles into the watch housing and that the holder can be matched to the respectively envisaged strap. Two holding members 37 can be provided in place of one holding member, with the pin 38 being held at its ends.

Figure 6:
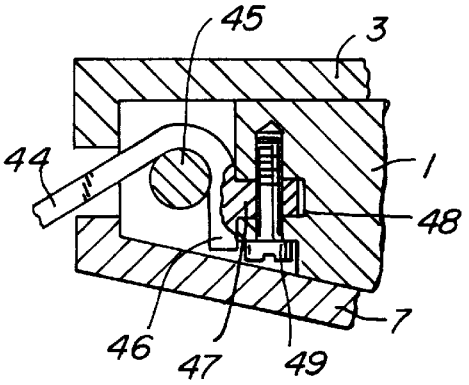
FIG. 6 shows a section of a portion in the 12 o'clock position with an embodiment of a holder for a bracelet.

FIG. 6 shows the arrangement of a clasp 44 at-the mechanism carrier 1. An axle 45 is installed in the mechanism carrier 1. The clasp has a holding section 46 with two lugs 47. The holding section 46 is disposed around the axle 45 and the holding portions 46 are secured in recesses 48 in the mechanism carrier 1 by means of screws 49. The clasp 44 is so dimensioned that it can be-spread through its elasticity so that the interruption in the contact surfaces 31, 31' can be reduced to a minimum.

A clasp will be understood to comprise an elongate member 44, for example in the form of a continuous strip or band of material, for example of metal or plastic, which can be pivoted about the axle 45, moved around the wearer's wrist, and clipped into place either at the other side of the watch, i.e. at the six o'clock position, or at the free end of a second elongate member secured to the watch at the six o'clock position.

If the free end of the first said elongate member is clipped to the watch at the six o'clock position then a further clasp element, for example a clasp lock or a clasp tongue must be provided there to receive the clasp tongue or lock provided at the free end of the first said elongate member. Such a further clasp element can be pivotally connected to the watch or fixedly connected thereto, depending on the precise design of the clasp.

If the free end of the first said elongate member is clipped to the free end of the second elongate member then a clasp lock or a clasp tongue must be provided at the free end of the second elongate member to receive the clasp lock or tongue provided at the free end of the first said elongate member. If such a second elongate member is used then the other end thereof can be secured to the watch, i.e. to the mechanism carrier 1, in the same manner as the first elongate member. It will be understood that the pivoting of clasp members (such as 44) about the axle 45 takes the form of progressive deflection of the clasp member around the fixed axle 45. Alternatively, the first or second elongate member could be made to rotate about the axle 45 or about an axle provided outside of the mechanism carrier, for example, about an axle resembling the strap holder 38 of the FIGS. 4 and 5 embodiment. Alternatively, the axle could be formed by a pin 38 held by two holding members at its ends, as described above with respect to a modification of the FIG. 4 and 5 embodiment.

It will be understood that a clasp of the above described kind comprising either one or two elongate members can be regarded as a type of fixed bracelet which should, however, be resilient to enable the clasp to be clipped in place.

Moreover, it will be understood that the watch of the present invention can also be provided with an expanding bracelet of known kind or with any other form of strap.

The term strap as used in the claims will be understood to cover any form of member used to retain the watch on the wearer's wrist, for example a leather strap, a clasp (a fixed bracelet), or an expanding bracelet or an elastic strap member. Moreover, it will be understood that although the strap is usually secured to the watch at two positions, typically the twelve o'clock and six o'clock positions, it would be possible to operate with a semi-rigid or rigid strap member partly encircling the wearer's wrist, with the elongate member only being secured to the watch at one position but being free at the other end.

Figure 7:
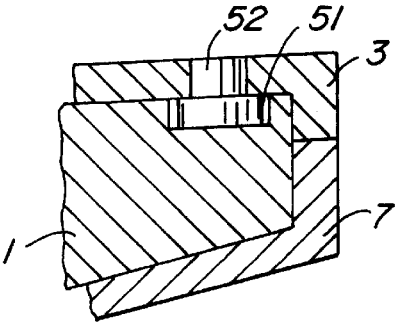
FIG. 7 shows an arrangement of a decorative part in section.

The embodiment of the watch housing of the invention makes it possible to mount a decoration or to design the watch housing as jewelry in an advantageous manner. As FIG. 7 shows, a recess 51 is formed in the mechanism carrier 1 and an interruption is formed in the upper part 3 in such a way that a decorative part, for example, a jewel 52 in a setting, can be arranged in the watch housing.

What is claimed is:

1. Watch housing for a wrist watch, the watch housing comprising a single-piece mechanism carrier having at least one holder for a strap; sealing members coupled to and sealing the mechanism carrier in a water-tight manner; and upper part of a shell-like shape engaging a first one of the sealing members against a portion of the mechanism carrier and including a watch glass being fixed therein; and a base part of a shell-like shape being mounted on the mechanism carrier and engaging a second one of the sealing members against another portion of the mechanism carrier, the upper part and base part having marginal portions which are detachably coupled to one another in a gap-free manner and surround the mechanism carrier in a form-fitted manner to releasably support the mechanism carrier therebetween.

2. Watch housing in accordance with claim 1, wherein at least one of the upper and base parts is formed as a pressed part.

3. Watch housing in accordance with claim 1, wherein the mechanism carrier comprises compartments for receiving a watch mechanism and a dial.

4. Watch housing in accordance with claim 3, wherein the sealing members are disposed in direct vicinity of the compartments.

5. Watch housing in accordance with claim 4, wherein the first sealing member is disposed in the compartments.

6. Watch housing in accordance with claim 5, wherein the first sealing member is disposed adjacent the dial.

7. Watch housing in accordance with claim 1, wherein the upper part and base part are made from a same material.

8. Watch housing in accordance with claim 1, wherein at least one of the upper and base parts comprises noble metal.

9. Watch housing in accordance with claim 1, further comprising a crown tube coupled to the mechanism carrier.

10. Watch housing in accordance with claim 1, further comprising at least one decorative part which is visibly disposed in the upper part.

11. Watch housing in accordance with claim 10, wherein the decorative part comprises a material selected from the group consisting of metal, ceramic, and jewel.

12. Watch housing in accordance with claim 10, wherein the decorative part comprises a jewel in a setting.

13. Watch housing in accordance with claim 1, wherein the at least one holder is disposed within the upper and base parts on the mechanism carrier.

14. Watch housing in accordance with claim 1, wherein the at least one holder is insertable into the mechanism carrier.

15. Watch housing in accordance with claim 1, wherein the at least one holder includes at least one holding member disposed in the mechanism carrier and at least one strap holder disposed in the at least one holding member and coupled to the at least one holding member.

16. Watch housing in accordance with claim 15, wherein the at least one holding member includes an insert part in the mechanism carrier and a receiving part coupled to the insert part for receiving the at least one strap holder.

17. Watch housing in accordance with claim 15, wherein the at least one strap holder comprises a pin.

18. Watch housing in accordance with claim 1, wherein the mechanism carrier comprises at least one holder for a clasp.

19. Watch housing in accordance with claim 18, wherein the at least one holder comprises at least one recess formed in the mechanism carrier, an axle disposed in the mechanism carrier for supporting the clasp, and a fastening member for securing the clasp to the mechanism carrier adjacent the at least one recess.

20. Watch housing in accordance with claim 1 wherein the marginal portions of the upper part and the base part are detachably coupled directly to one another by mechanical fasteners.

21. Watch housing in accordance with claim 1 wherein the marginal portion of the upper part includes a plurality of threaded blind bores and the marginal portion of the base part includes a plurality of through holes generally aligned with the threaded blind bores for receiving threaded fasteners detachably coupling the marginal portion of the base part to the marginal portion of the upper part.

22. Watch housing in accordance with claim 1 wherein the marginal portions of the upper part and the base part have contact surfaces that contact one another when the marginal portions are coupled to one another.

23. Watch housing having a generally circular shape for a wrist watch, the watch housing comprising a single-piece mechanism carrier having at least one holder for a strap and sealed in a water-tight manner by a plurality of sealing members, an upper part being generally concentrically aligned with the mechanism carrier and including a watch glass being fixed therein and an upper marginal portion, and a base part being mounted on the mechanism carrier and generally concentrically aligned with the upper part and having a lower marginal portion which is located to detachably couple with the upper marginal portion in a gap-free manner to surround the mechanism carrier in a form-fitted manner to detachably support the mechanism carrier therebetween.

24. Watch housing for a wrist watch, the watch housing comprising a mechanism carrier; sealing members coupled to and sealing the mechanism carrier in a water-tight manner; and upper part of a shell-like shape engaging a first one of the sealing members against a portion of the mechanism carrier and including a watch glass being fixed therein; and a base part of a shell-like shape engaging a second one of the sealing members against another portion of the mechanism carrier, the upper part and base part having marginal portions which are detachably coupled to one another in a gap-free manner and surround the mechanism carrier in a form-fitted manner to releasably support the mechanism carrier therebetween to permit convenient replacement of at least one of the upper part and base part.

* * * * *